US012324555B2

(12) United States Patent
Johnson

(10) Patent No.: US 12,324,555 B2
(45) Date of Patent: Jun. 10, 2025

(54) DISHWASHER-SAFE WASHING STAND FOR CONICAL BAGS

(71) Applicant: Nicole Johnson, Clifton Park, NY (US)

(72) Inventor: Nicole Johnson, Clifton Park, NY (US)

( * ) Notice: Subject to any disclaimer, the term of this patent is extended or adjusted under 35 U.S.C. 154(b) by 0 days.

(21) Appl. No.: 18/303,947

(22) Filed: Apr. 20, 2023

(65) Prior Publication Data

US 2024/0349980 A1 Oct. 24, 2024

(51) Int. Cl.
*A47L 15/50* (2006.01)

(52) U.S. Cl.
CPC ..... *A47L 15/505* (2013.01)

(58) Field of Classification Search
CPC ..... A21C 15/005; A47L 19/04; A47L 15/505; A23G 3/28
See application file for complete search history.

(56) References Cited

U.S. PATENT DOCUMENTS 3,285,202 A 11/1966 Macmanus
3,367,018 A * 2/1968 Bell ..... B21D 1/08 72/369
3,424,076 A * 1/1969 Brady ..... A47J 37/1295 D7/672
4,718,441 A 1/1988 Daum et al.
4,874,141 A 10/1989 Schulz
5,456,046 A * 10/1995 Vitalune ..... A01G 5/04 248/214
5,538,050 A 7/1996 Galdon
5,794,792 A 8/1998 Convertino
5,943,786 A * 8/1999 Stahley ..... F26B 21/006 34/106
6,109,581 A * 8/2000 Kracke ..... A47G 23/0241 211/74
6,125,739 A * 10/2000 Jernigan ..... A47J 43/18 99/347
6,268,000 B1 7/2001 Romer
6,557,567 B2 5/2003 Mood
6,915,808 B2 * 7/2005 McConnell ..... A47L 15/505 134/201
6,971,611 B2 12/2005 Folkmar
D522,807 S * 6/2006 Dow ..... D7/409
D558,519 S * 1/2008 Zemel ..... D7/409
7,669,721 B2 * 3/2010 Kemper ..... A47L 19/04 211/41.3

(Continued)

*Primary Examiner* — Patrick D Hawn
(74) *Attorney, Agent, or Firm* — Dunlap Bennett & Ludwig, PLLC; Anna L. Kinney

(57) ABSTRACT

A washing stand includes an open-ended, truncated cone formed of a dishwasher-safe and food-safe material. The cone has a sidewall with evenly spaced holes. The holes permit fluid to pass through the sidewall and flow into an article placed over the open-ended, truncated cone. A method of manufacturing the washing stand includes cutting a sheet of the material to a predetermined size; puncturing the sheet to form the holes; rolling the sheet into the open-ended truncated cone, with a first edge overlapping a second edge; and bonding the first edge to the second edge. The size corresponds to a size of a pastry bag. The holes are spaced about 0.25 inch-about 1 inch apart throughout the sheet. The support allows the pastry bags to be cleaned, disinfected, and sanitized inside and out. It also enables more than one bag to be washed simultaneously, saving time.

9 Claims, 3 Drawing Sheets

(56) References Cited

U.S. PATENT DOCUMENTS

| | | | | |
|---|---|---|---|---|
| 7,703,723 | B1 | 4/2010 | Cooper et al. | |
| 7,802,763 | B2 | 9/2010 | Faller et al. | |
| 7,879,381 | B2 * | 2/2011 | Dow | A23L 13/428 426/523 |
| 8,201,709 | B1 * | 6/2012 | Namigata | A21C 15/005 222/475 |
| D683,504 | S * | 5/2013 | Clores | D32/3 |
| 8,763,835 | B2 * | 7/2014 | Tirone | A47J 9/00 426/115 |
| 8,833,381 | B2 * | 9/2014 | Moore | A47L 25/00 134/201 |
| 8,955,806 | B1 | 2/2015 | Watson | |
| 8,978,918 | B2 | 3/2015 | Tirone et al. | |
| 9,186,039 | B2 * | 11/2015 | Pipp | A47L 15/505 |
| 9,635,977 | B2 * | 5/2017 | Lambert | A47J 37/0694 |
| D810,497 | S * | 2/2018 | Costa Llonch | D7/354 |
| 10,086,979 | B2 * | 10/2018 | Sherman | B65D 35/38 |
| 10,258,192 | B1 * | 4/2019 | Cloutier | A47J 36/16 |
| 10,648,720 | B2 * | 5/2020 | Yoshikawa | F25C 1/22 |
| D911,764 | S * | 3/2021 | Tucker | D7/354 |
| D913,469 | S * | 3/2021 | Song | D23/365 |
| D925,979 | S * | 7/2021 | Licata | D7/354 |
| 11,091,287 | B1 * | 8/2021 | Krechowiecki | B65B 67/12 |
| 11,212,966 | B2 * | 1/2022 | Shaffer | A47G 7/02 |
| 2002/0095863 | A1 * | 7/2002 | Receveur | A47G 7/041 47/39 |
| 2011/0108682 | A1 | 5/2011 | Boaz et al. | |
| 2011/0192808 | A1 * | 8/2011 | Buhl | A47L 15/505 211/41.9 |
| 2015/0028056 | A1 | 1/2015 | Massis | |
| 2017/0325466 | A1 | 11/2017 | Folkmar | |

* cited by examiner

DISHWASHER-SAFE WASHING STAND FOR CONICAL BAGS

BACKGROUND OF THE INVENTION

The present invention relates to piping bags or pastry bags and, more particularly, to a dishwasher-safe washing stand for conical bags.

Piping or pastry bags must be cleaned by hand as their lack of rigidity does not allow them to stand inside a conventional or commercial dishwasher. Washing piping or pastry bags by hand is messy, time consuming, and does not allow the bag to be evenly cleaned, thoroughly disinfected, and sanitized. There are no products that allow piping/pastry bags to stand inside a conventional/commercial dishwasher.

As can be seen, there is a need for a means of machine-washing piping or pastry bags.

SUMMARY OF THE INVENTION

In one aspect of the present invention, a washing stand comprises an open-ended, truncated cone formed of a dishwasher-safe and food-safe material, having a sidewall with a plurality of evenly spaced apertures therein, wherein the evenly spaced apertures are operative to permit fluid to pass through the sidewall and flow into an article placed over the open-ended, truncated cone.

In another aspect of the present invention, a method of manufacturing the washing stand comprises cutting a sheet of the dishwasher-safe, food-grade material to a predetermined size corresponding to a size of a pastry bag; puncturing the sheet to form the plurality of evenly spaced apertures about 0.25 inch-about 1 inch apart throughout the sheet; rolling the sheet into the open-ended truncated cone, with a first edge overlapping a second edge; and bonding the first edge to the second edge.

With the conventional or commercial dishwasher's water pressure, high heat, and sanitizing capabilities, the support allows the piping/pastry bags to be cleaned, disinfected, and sanitized inside and out, lowering the risk or bacteria forming inside the piping/pastry bag as well as cross contamination of food stuffs. It also enables more than one bag to be washed simultaneously, saving time.

The conical washing stand may also be used to clean and sanitize, in a dishwasher, various items that lack rigidity and fit atop or over the pastry bag support.

These and other features, aspects and advantages of the present invention will become better understood with reference to the following drawings, description, and claims.

DETAILED DESCRIPTION OF THE INVENTION

Figure 1:
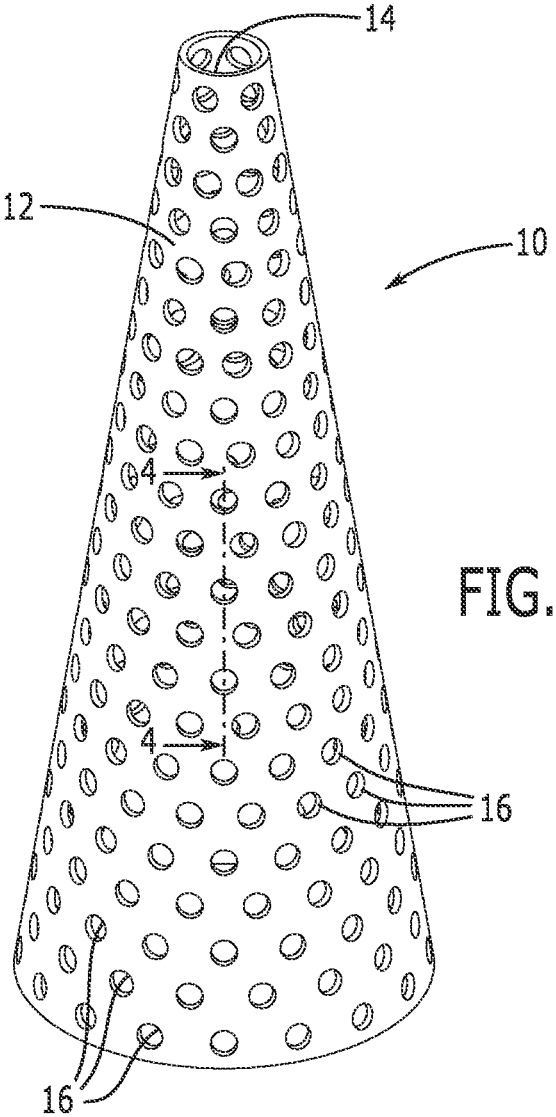
FIG. 1 is a front perspective view of a bag cleaner support according to an embodiment of the present invention.
Figure 2:
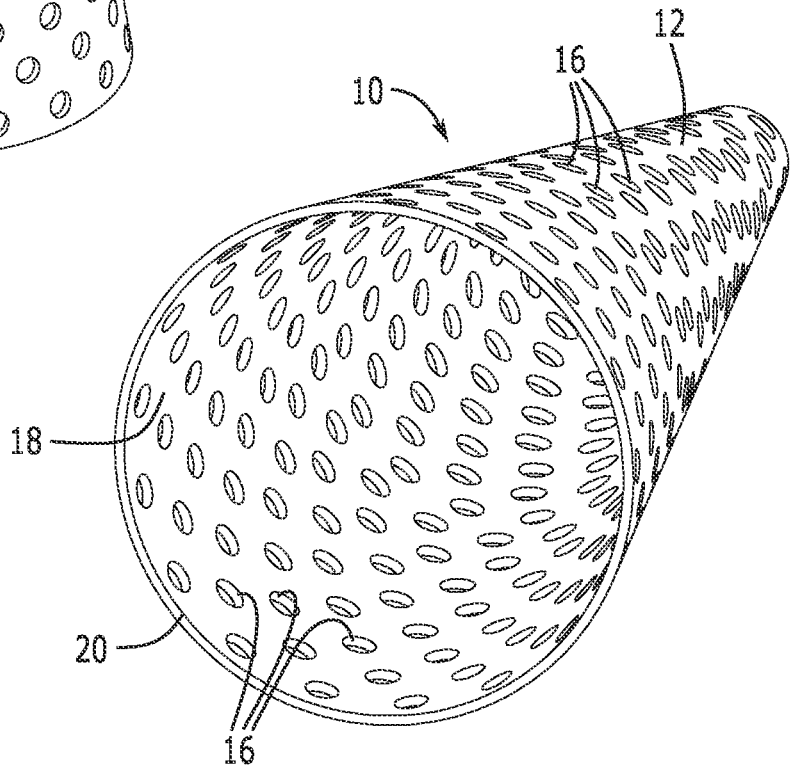
FIG. 2 is a bottom perspective view thereof.
Figure 3:
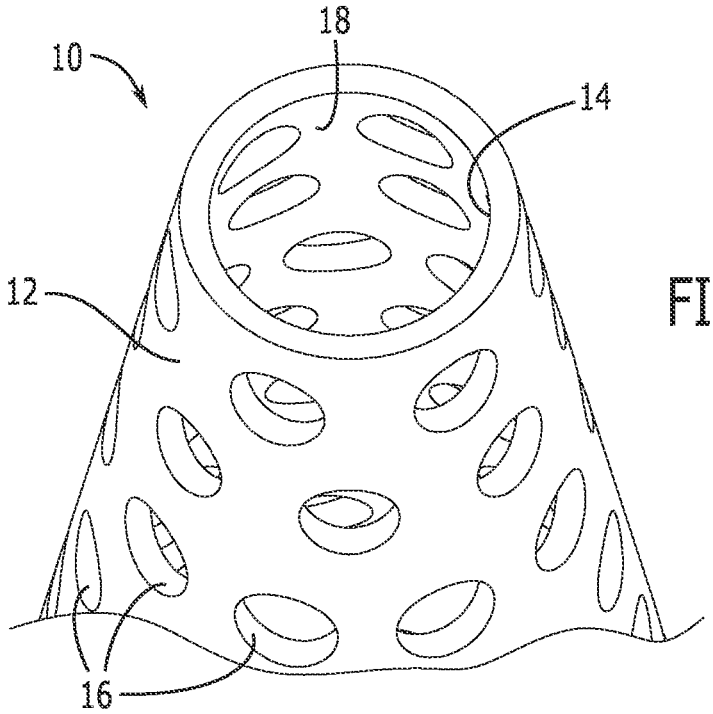
FIG. 3 is a detail top perspective view thereof.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

As used herein, the terms "piping bag" and "pastry bag" are interchangeable.

Broadly, one embodiment of the present invention is an open-ended, truncated cone bag support having a conical sidewall formed with a plurality of evenly distributed apertures.

The double open-ended cone shape enables a piping or pastry bag to stay upright in an open position inside a conventional or commercial dishwasher during a washing cycle so that the inside and outside of the piping/pastry bag may be cleaned simultaneously. The cone is configured and dimensioned to fit inside of a predetermined article, such as a pastry bag.

The evenly distributed holes allow the bag surface facing the cone to be completely and thoroughly cleaned. The holes are operative to permit fluid to pass through the sidewall and flow into an article placed over the support.

The material of manufacture is not particularly limited provided that it is dishwasher-safe and food-safe, and may include, for example, food grade silicone rubber sheet (medium hardness), polypropylene plastic sheet (e.g., with a minimum thickness of about 1/30 inch), and in some embodiments, a suitable adhesive for the sheet used.

The bonding means for forming the truncated cone is not particularly limited. Adhesive or glue may be used in some embodiments, while a different bonding technique may reduce the overlap space needed and/or provide a stronger bond. The bonding technique may form a bonded seam extending along the sidewall from a first open end to a second open end. A preset mold may eliminate the use of adhesive entirely. Moreover, a three-dimensionally (3-D) printed cone may be produced without adhesive and without the use of a hole punch. In these embodiments, the support may be a unitary, injection molded or three-dimensionally printed piece.

A method of making the cone support according to an embodiment of the present invention may include the following steps. Cut a sheet of dishwasher-safe, food-grade material to a predetermined size corresponding to a size of piping/pastry bag. Lay the sheet flat and use a hole punch to punch evenly distributed holes or evenly spaced apertures about 0.25 inch-about 1 inch apart throughout the sheet. Roll the sheet material with punched holes into an open-ended truncated cone shape, leaving approximately a 1-inch overlap for adhesion on each edge, i.e., a first edge overlapping a second edge. To permanently secure the double open-ended cone shape, apply adhesive along the overlap region and allow to dry or cure completely. Thermal bonding may alternatively be used to secure the double open-ended cone shape.

A method of using the cone according to an embodiment of the present invention includes placing a soiled piping/pastry bag over the cone, either with the soiled side facing the cone or inverted to have the soiled side facing outward. Stand the piping/pastry bag with support inside a dishwasher. Let the dishwasher run on a full cycle. Once the cycle is complete, remove the pastry bag with the support from the dishwasher. The clean pastry bag may be separated from the piping/pastry bag, the cone may be used to air dry the piping/pastry bags, and/or the piping/pastry bags may be stored on the cones, allowing them to keep their shape in storage.

Referring to FIGS. 1 through 5, FIGS. 1-3 show a bag cleaner support 10 according to an embodiment of the present invention, having a conical sidewall with an outer surface 12 and an inner surface 18, with a plurality of apertures 16 formed therethrough. The conical sidewall forms an open, truncated cone with an open-ended top 14 and an open-ended bottom 20.

Figure 4:
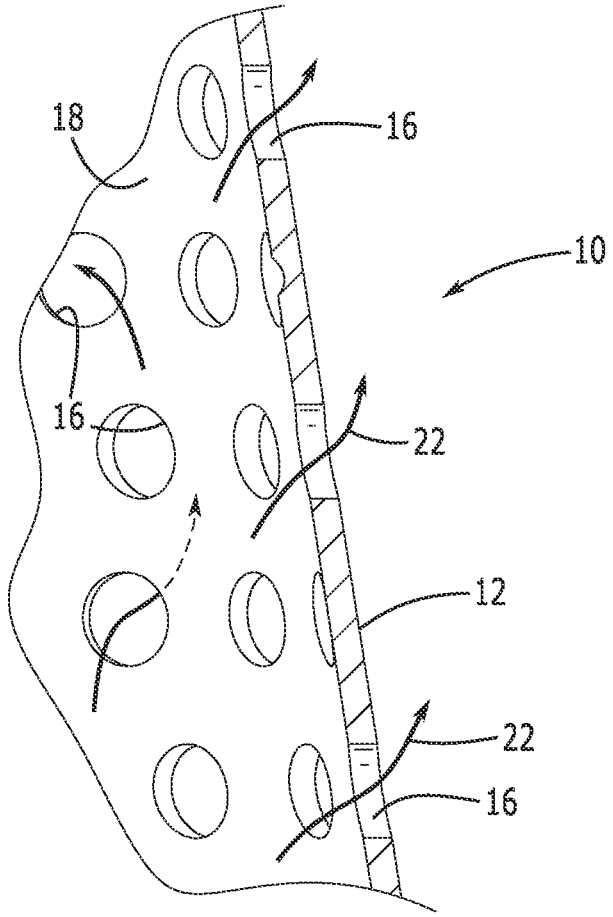
FIG. 4 is a detail cross-sectional view thereof, taken along line 4-4 of FIG. 1.
Figure 5:
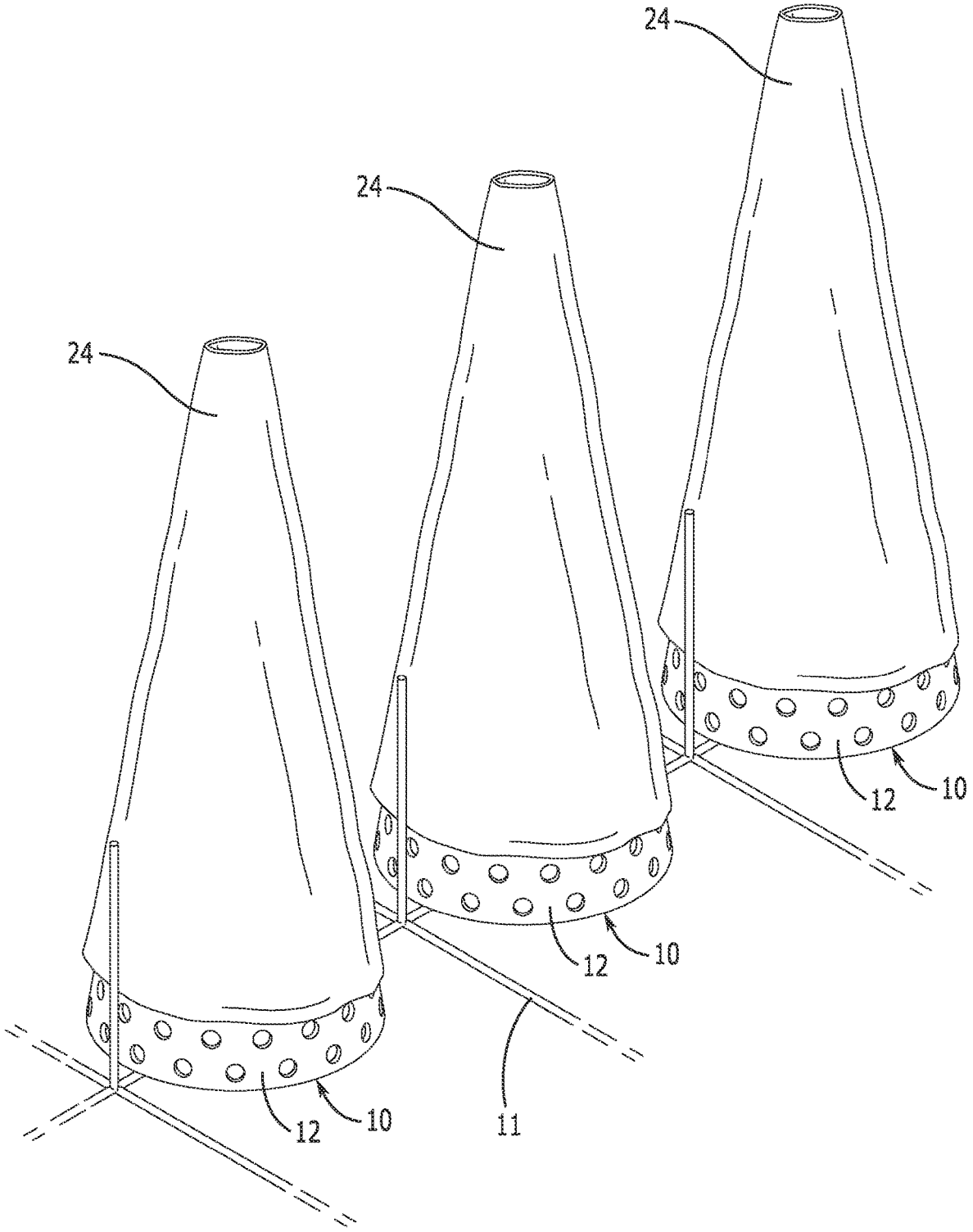
FIG. 5 is a front perspective view thereof, shown in use.

As shown in FIG. 4, the apertures 16 enable fluid flow 22 through the sidewall when in use as shown in FIG. 5, wherein soiled piping/pastry bags 24 are placed over the supports 10 on a dishwasher rack 11.

It should be understood, of course, that the foregoing relates to exemplary embodiments of the invention and that modifications may be made without departing from the spirit and scope of the invention as set forth in the following claims.

What is claimed is:

1. A washing stand comprising:

an open-ended, truncated cone, having a first open end having an opening diameter of about 1.5 inches or less and a second open end, formed of a material selected from the group consisting of silicone rubber and polypropylene, having a sidewall with a plurality of evenly spaced apertures therein, formed in more than four rows extending around a circumference of the sidewall and from the first open end to the second open end;

wherein the evenly spaced apertures are operative to permit fluid to pass through the sidewall and flow into a pliant article placed over the open-ended, truncated cone; and wherein the open-ended, truncated cone is dimensioned and configured to retain the pliant article in an open and upright position.

2. The washing stand of claim 1, wherein the pliant article is a pastry bag.

3. The washing stand of claim 1, wherein the open-ended, truncated cone is a unitary, injection molded or three-dimensionally printed piece.

4. The washing stand of claim 1, wherein the sidewall has a bonded seam extending from a first open end to a second open end of the open-ended, truncated cone.

5. The washing stand of claim 1, wherein the plurality of evenly spaced apertures are each placed at about 0.25 inch-about 1 inch from adjacent apertures.

6. A method of manufacturing the washing stand of claim 1, comprising:

a) cutting a sheet of the material to a predetermined size corresponding to a size of a pastry bag;

b) puncturing the sheet to form the plurality of evenly spaced apertures about 0.25 inch-about 1 inch apart throughout the sheet;

c) rolling the sheet into the open-ended truncated cone, with a first edge overlapping a second edge to form the sidewall having the plurality of evenly spaced apertures formed therein; and d) bonding the first edge to the second edge.

7. The method of manufacturing of claim 6, wherein the bonding comprises applying an adhesive and allowing the adhesive to cure.

8. The method of manufacturing of claim 6, wherein the bonding comprises thermal bonding.

9. The washing stand of claim 1, wherein the plurality of evenly spaced apertures is more than 25.

* * * * *